US005099662A

United States Patent [19]

Tsai

[11] Patent Number: 5,099,662

[45] Date of Patent: Mar. 31, 1992

[54] CONTRACTIBLE HANDCUFF

[76] Inventor: Boter Tsai, 1st Fl., No. 152, Lu Chang Street, Sanchung City, Taipei, Taiwan

[21] Appl. No.: 637,263

[22] Filed: Jan. 3, 1991

[51] Int. Cl.[5] ..... E05B 75/00

[52] U.S. Cl. ..... 70/16

[58] Field of Search ..... 70/16, 15, 17, 14; 119/128; 128/878, 879, 882

[56] References Cited

U.S. PATENT DOCUMENTS 4,909,051 3/1990 Lee ..... 70/16

4,910,831 3/1990 Bingold ..... 70/16

4,969,419 10/1990 Karriker ..... 128/879

*Primary Examiner*—Robert L. Wolfe

*Attorney, Agent, or Firm*—Morton J. Rosenberg; David I. Klein

[57] ABSTRACT

A contractible handcuff with a switch on its body to control a motor in the body for normal or reverse rotation in order to extend or retract a handcuff which is designed with a plurality of slots, a chain and a hook operating in a manner that the handcuff can bend and bind any substance it touches immediately by nature of its structure, a slightly curved flexible metal tape, and the hook can lock such substance in place.

3 Claims, 7 Drawing Sheets

CONTRACTIBLE HANDCUFF

BACKGROUND OF THE INVENTION

The present invention provide a contractible handcuff, particularly a handcuff in the form of a metal tape which can bend and bind any substance it touches immediately by extending and then contracting of the handcuff.

Generally it is necessary to beat down a person before any police to handcuff such person. Therefore, fighting is unavoidable if the person don't want to be handcuffed, such fighting may result in death or injury of police. Therefore, hesitation in arresting of such person may provide the person an opportunity to escape. In view of the defect of the conventional handcuff, the invention created a contractible handcuff.

SUMMARY OF THE INVENTION

The present invention provides a contractible handcuff with a switch on its body to control a motor in the body for normal or reverse rotation in order to extend or retract a handcuff which is designed with a plurality of slots, a chain and a hook operating in a manner that the handcuff can bend and bind any substance it touches immediately by nature of its structure, a slightly curved flexible metal tape, and the hook can lock such substance in place.

DESCRIPTION OF THE PREFERRED EMBODIMENT

Figure 1:
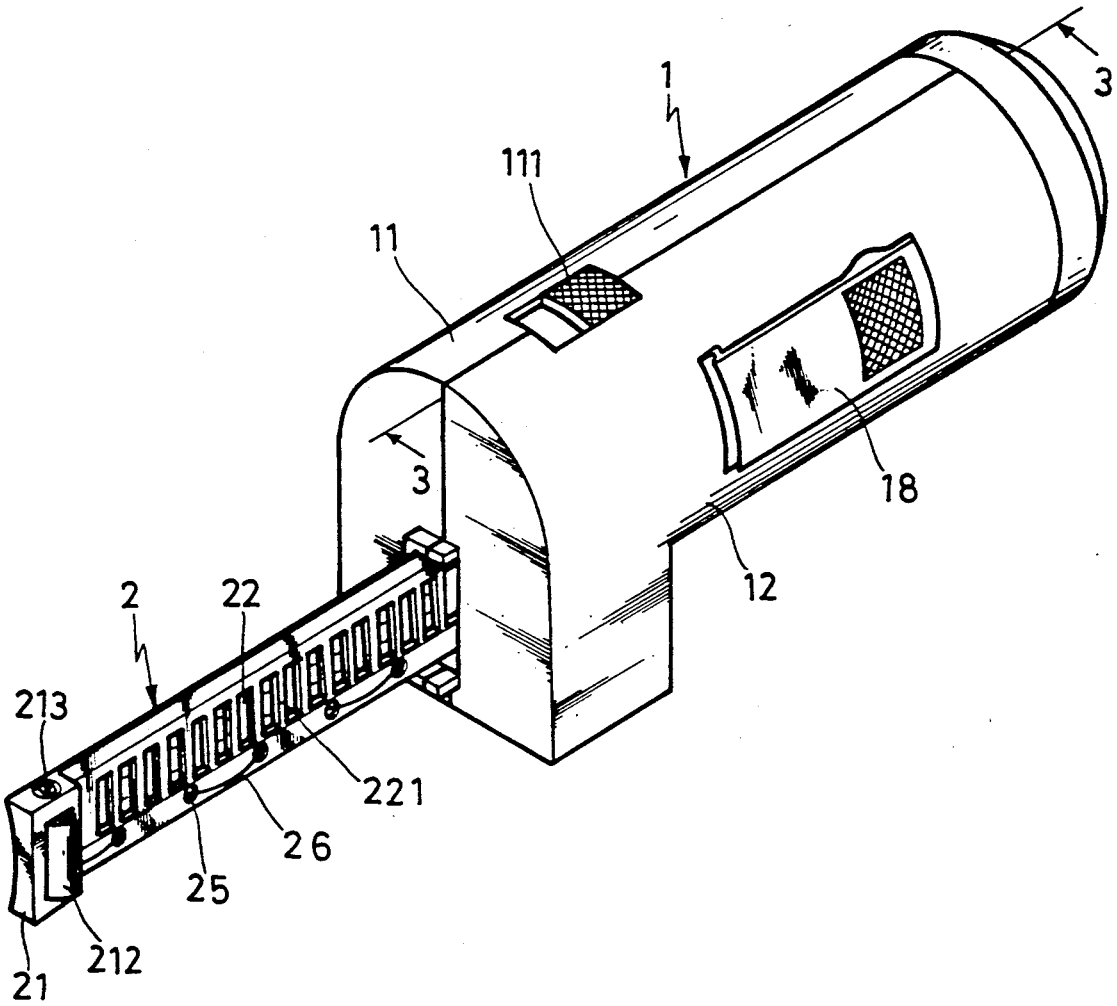
FIG. 1 is a perspective view of an embodiment according to the present invention.
Figure 2:
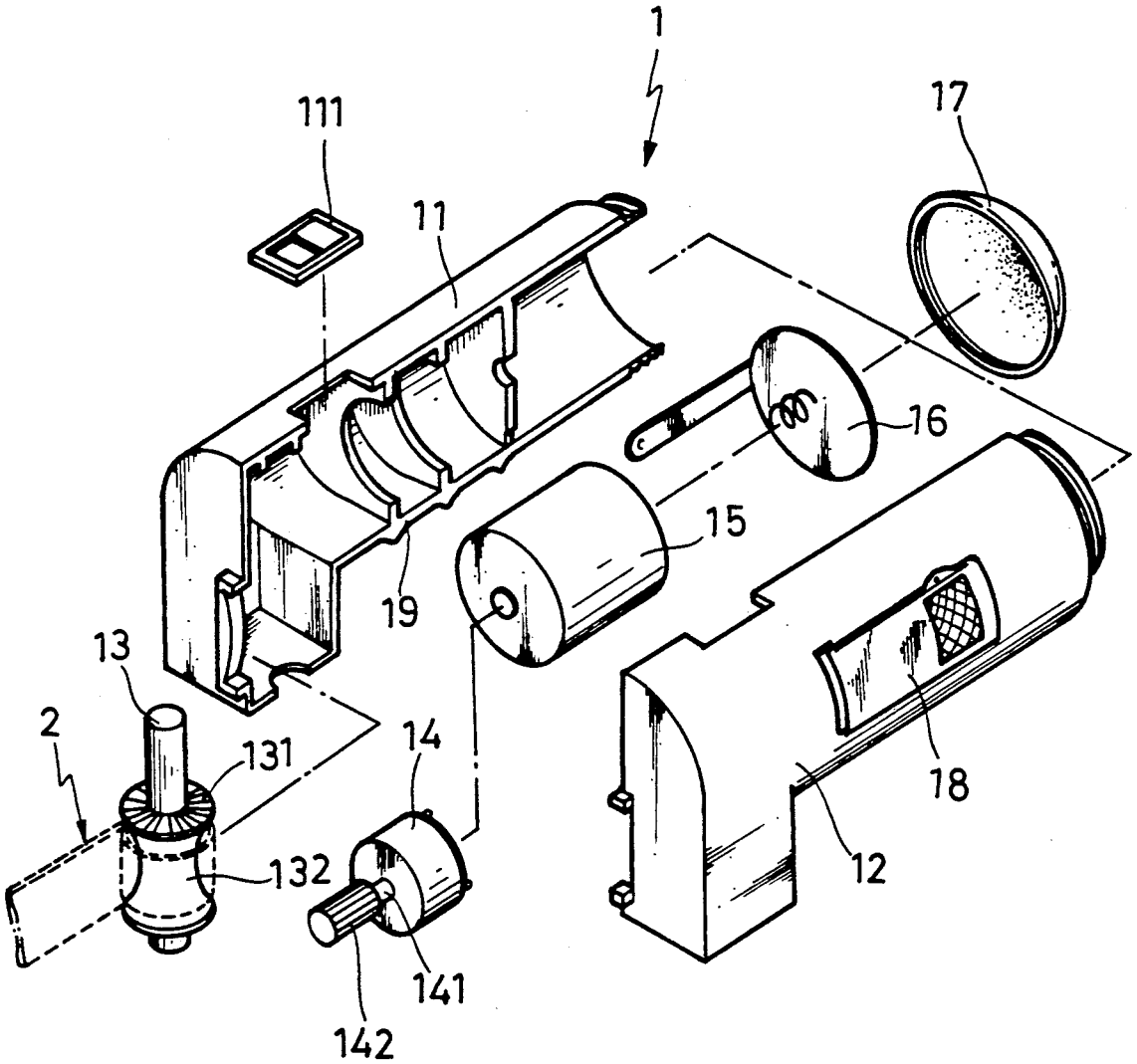
FIG. 2 is a fragmented view of the embodiment according to the present invention.
Figure 3:
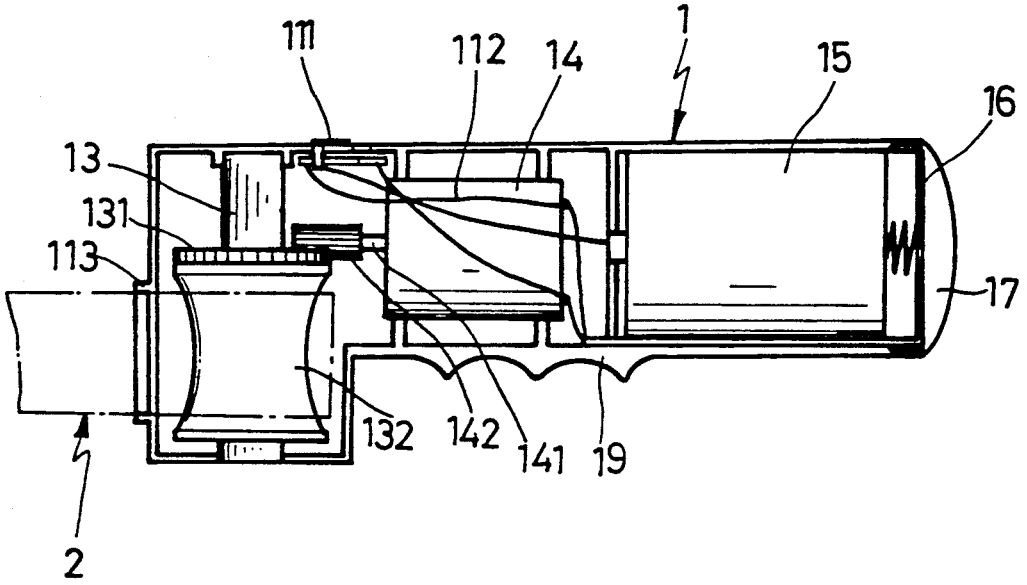
FIG. 3 is a cross sectional view of the embodiment taken along the line 3—3 in FIG. 1.
Figure 4:
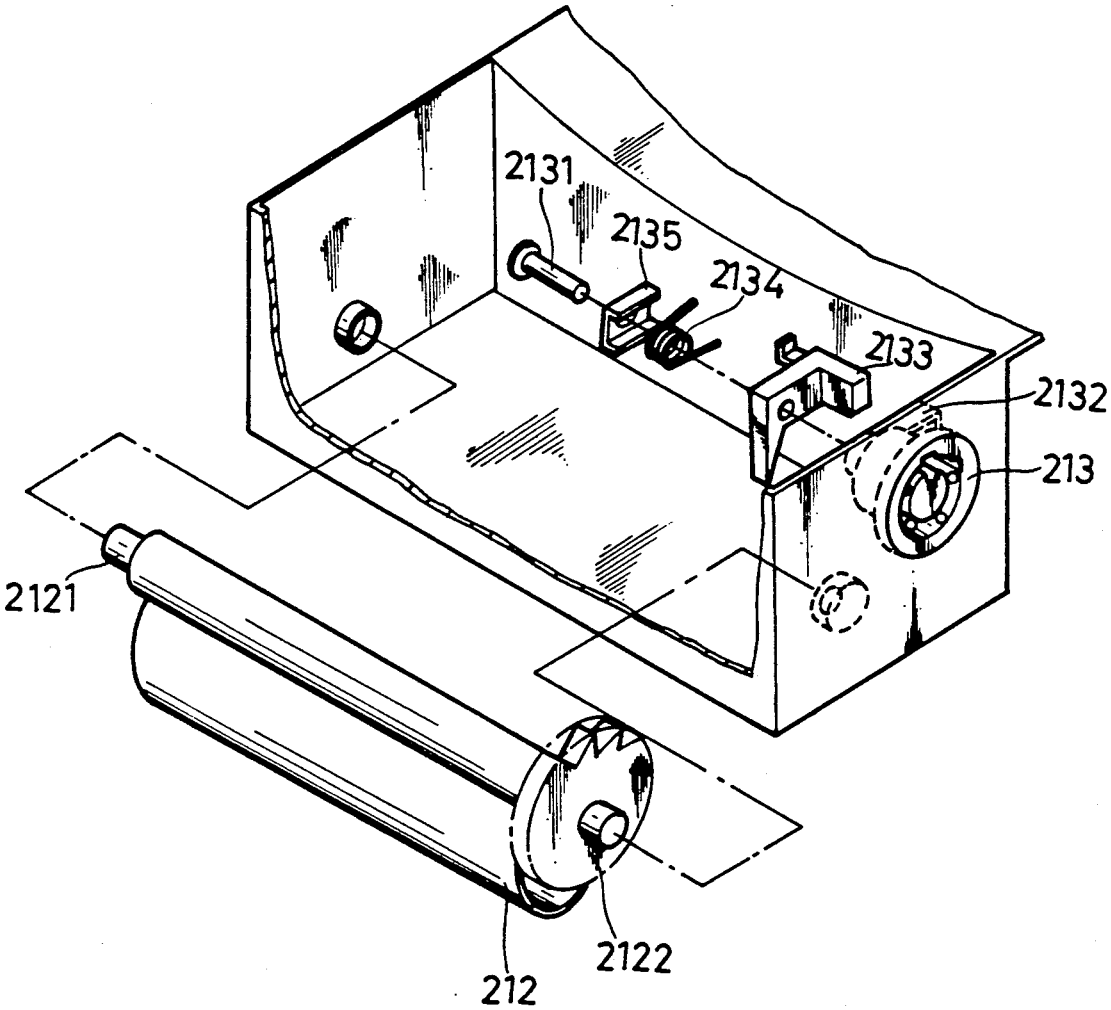
FIG. 4 is a fragmented view of the locker according to the present invention.
Figure 5:
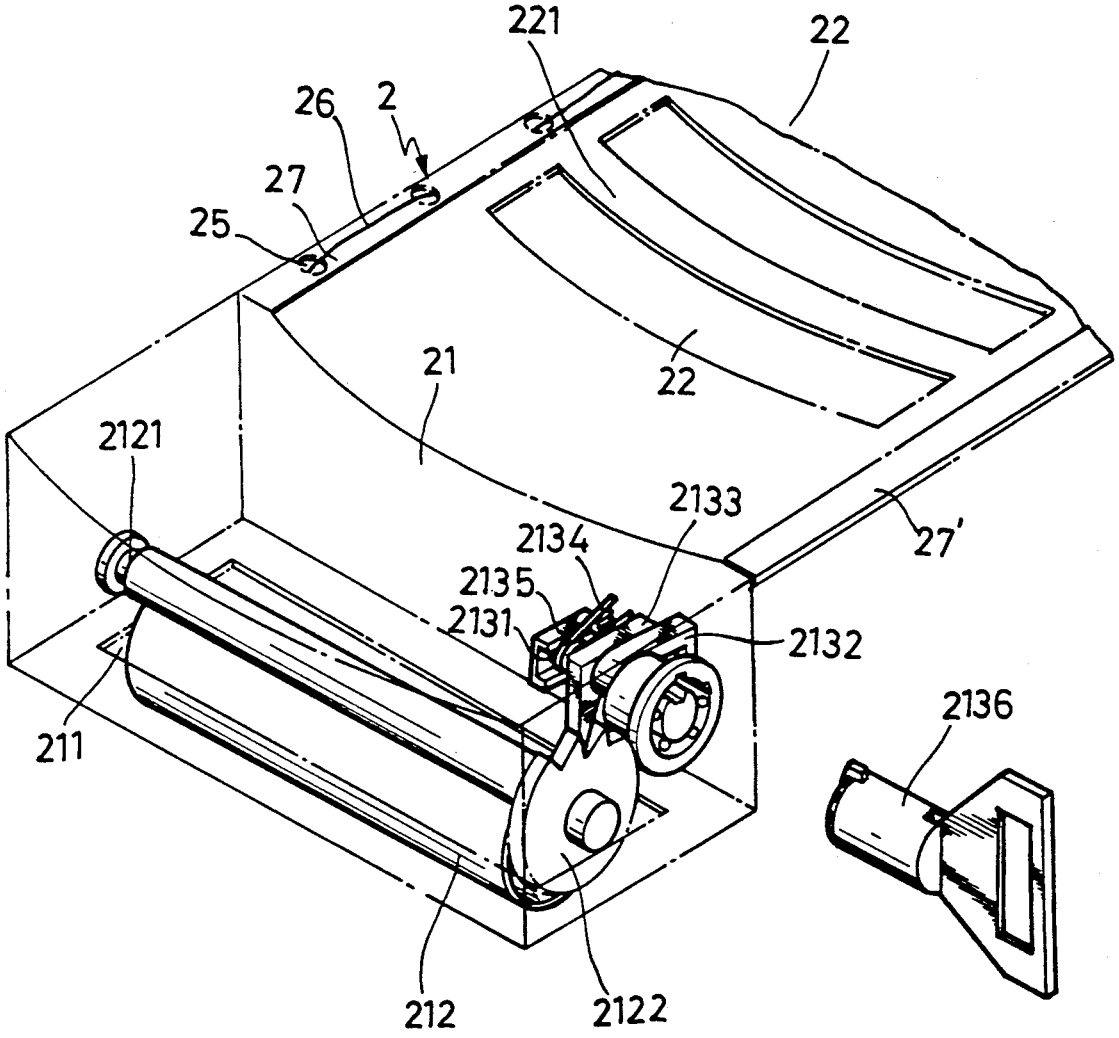
FIG. 5 illustrates the assembly of the locker according to the present invention.

As shown in FIGS. 1, 2, and 3, the present invention comprises mainly a body (1) and a handcuff (2). The body (1) is composed of a left body component (11) and a right body component (12). In the body (1) a reel (13), a motor (14), a battery (15), a conductor (16) and a back cover (17) are positioned in order from the front side to the back. On the body (1) a hook (18) is designed for hanging on user's waist belt, and a recession (19) is made to help gripping. A switch (111) is installed outside the body (1) to form a continuous circuit with the motor (14), the battery (15) and the conductor (16) by using of an electric wire (112). The switch (111) is used to operate the motor (14) for rotating the reel (13) in either normal or reverse direction, and for extending or retracting the handcuff (2). The motor (14) is completed with a gear (142) at its driving shaft (141) to engage with a gear (131) at the reel (13) beneath it in order to drive the reel (13) for rotation. On the reel (13) there is a take-up drum (132) to receive the handcuff (2), An U-like guide (113) is designed beneath the front side of the body (1) to guide taking up of the handcuff (2).

As shown in FIGS. 1, 2, 4 and 5, the handcuff (2) according to the present invention is in the form of a tape made of flexible metal tape with a slightly curved cross section. Normally the handcuff (2) is wound around the reel (2) in the body (1) with an end completed with a locker (21) exposed outside the body (1). The locker (21) is made of permanent magnet, with a slot (211) and a hook (212) at the lower side. The hook (212) is positioned in the locker (21) by a support (2121), which has a ratchet (2122) at one side to control the hook (212) for engaging with any slot (22) at the handcuff, and to lock the hook (212) there by means of a lock (213). The lock (213) is composed of a stub (2132), a latch (2133) and a torsional spring (2134) placed on a spindle (2131) in order and positioned by a support block (2135). To engage with the stopper (221) between two consecutive slots (22), the hook (212) extends a engaging element (221) in a direction as shown by the arrow in FIG. 5, the ratchet (2122) is caused to pass through the latch (2133) without any obstacle, and the hook is firmly held and prevented from further rotation when the stopper (221) is engaged with the hook (212). Without use of the key designed for the purpose of the present invention, it is impossible to disengage the hook from the slots (22) because the ratchet (2122) on the hook (212) is restricted by the latch (2133), and the latch (2133) is prevented from movement by the hook (212). To disengage the hook (212) from the stopper (221), the key (2136) designed for such purpose must be inserted into and rotated in the lock (213) to push the stub (2132) to displace downwards, and consequently move the latch (2133) upwards to disengage from the ratchet (2122), and finally the hook (212) can be turned to release the handcuff (22). The spring (2134) will then return the latch (2133) to its initial position and resume the engagement condition.

Figure 6:
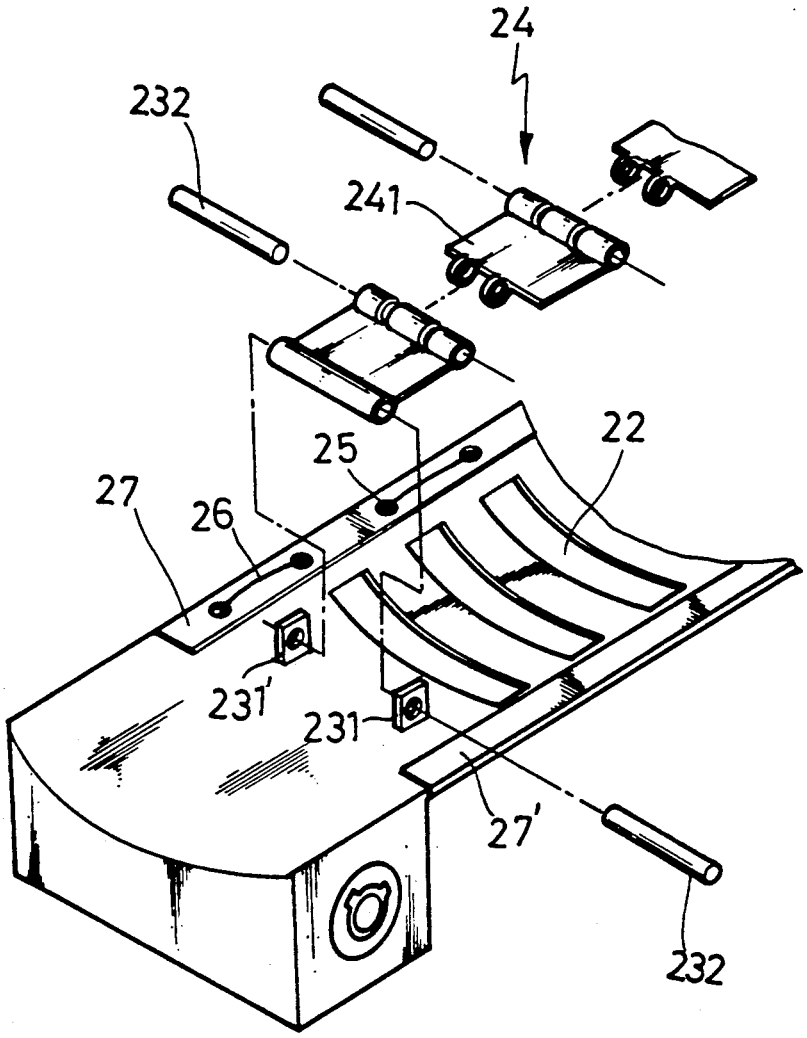
FIG. 6 is a fragmented view of the chain for the handcuff according to the present invention.
Figure 7:
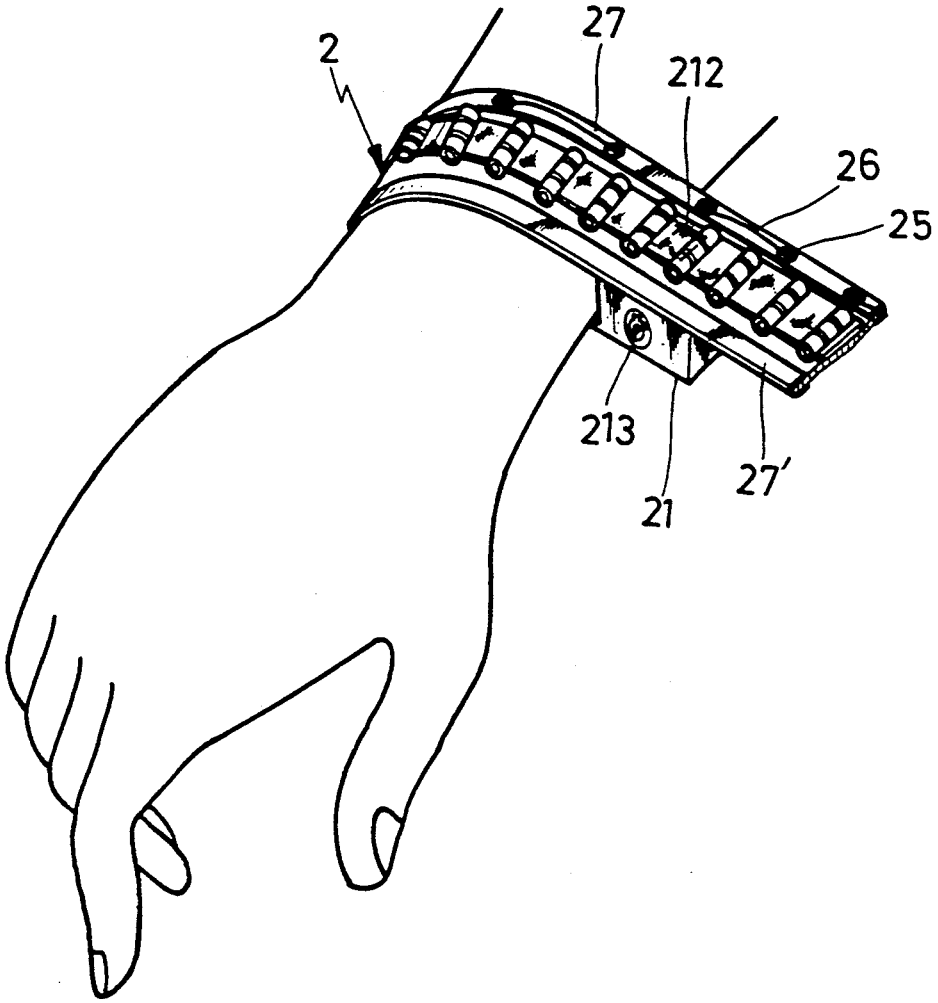
FIG. 7 illustrated the preferred embodiment according to the present invention.

As shown in FIG. 6, The handcuff (2) has a pair of fixed supports (231 and 231') and a plurality of slots (22) in a well arranged row. The fixed supports (231 and 231') are designed to connect to a chain (24) comprising a plurality of chain components (241) by means of pins (232) so that the chain becomes an integrated part of the handcuff (2) to increase the strength of the handcuff (2). Along a lateral side of the handcuff (2) a plurality of equidistant holes (25) are made for passing through and extending a control rope (26) to the locker (21). The control rope (26) is hence can be extended and retracted together with the handcuff (2).

Please refer to FIGS. 2–7 for operation of the present invention. By operation of the switch (111) on the body (1) the motor (14) is turned on to drive the reel for extending the handcuff (2) rapidly. Through the guidance of the guide (113) in front of the body (1), the handcuff (2) is maintained extending straightly. As soon as it touches any object, the handcuff (2) bends and bind the object because it is a thin flexible metal tape structure with a slightly curved cross section. As it is made of permanent magnet, the locker (21) attacks the handcuff (2), and the hook (212) beneath the locker (21) is extended by inertia force to engage with the stopper (221) at the slots (22) of the handcuff (2), and is firmly positioned by the ratchet (2122) at the latch (2133) of the lock (213) so that it is impossible to disengage the hook (212) from the stopper (221) by hand. The locker (21) is controlled by the control rope (26) connecting to the body (1), pulling of the control rope (26) can help bending of the handcuff (2). At each lateral side of the handcuff (2) according to the present invention there is a protective edge (27 or 27') to strengthen the structure of the handcuff (2), and to prevent from bodily injury while using the handcuff (2).

The present invention has the following features:

(1) By using of the present invention, any police can conquer any person simply by extending the handcuff to touch such person's hand, foot, or other part without fighting, because the handcuff can bend and lock immediately, (2) A switch is incorporated on the body to control the motor for normal or reverse rotation in order to extend or retract the handcuff rapidly. Control of the present invention is very easy.

(3) The handcuff is incorporated with a chain to increase its strength, and hence it is not easy to break the handcuff by hand.

(4) The handcuff has a locker with a hook at the front end to engage with a stopper at the slots on the handcuff by the attraction from the locker which is made of permanent magnet. The hook is firmly held by action of a ratchet and a latch so that disengagement of the hook from the stopper by hand become impossible, and the handcuff is hence can't be released unless the key specifically designed is used.

(5) The handcuff is made of thin flexible metal tape with a slightly curved cross section so that it can bend and bind rapid as soon as it touches any object, and a control rope is incorporated to help quick bending and binding.

(6) The present invention is compact and portable, it is a very practical and useful tool for the police.

(7) With its self bending and binding action, it can be used as a car protection tool to bind invader in car automatically.

(8) It can be used as a burglar-proof device placed at entrance of any house.

(9) It can be used as a body guard for self-defense, and it can be used to pick up substance at some distance away, such as fruit from a tree.

I claim:

1. A contractible handcuff comprising a body composed of a left body component and a right body component, in which a reel, a motor, a battery, a conductor and a back cover are positioned in order, a hand gripping recession surface is designed on the outer surface, a hook and a control switch are incorporated on it, and the motor has a gear incorporated at its driving shaft to engage with a gear at the reel having a take-up drum to take up a handcuff, an U-like guide at the front end of the body to guide extension of the handcuff and to maintain the handcuff to extend straightly;

a handcuff made of thin flexible metal tape with slightly curved cross section, winding around the reel normally, having a locker made of permanent magnet exposed outside the body and with a hook corresponding to some slots at the lower part, a ratchet at a side of the hook, a locking device composed of a stub, a latch and a spring arranged on the locker's spindle at a side of the locker, a protective edge at each lateral side, and a plurality of slots forming stopper between each two consecutive slots on the slightly curved cross-sectional surface for securing of the hook, and a chain connected to the handcuff by means of pins;

characterized by the handcuff structure which can bend and bind any substance it touches immediately while it is extended, and has its locker attracted the handcuff, its hook to be firmly held by a stopper formed between two slots by inertia force, and secured thereto by the locking effect between the latch and the ratchet on the hook.

2. A contractible handcuff as claimed in claim 1 wherein the locker and the body is connected by a control rope passing through a plurality of equidistant holes on the handcuff in order to cause the handcuff to bend and bind any substance it touches immediately while it is extended.

3. A contractible handcuff as claimed in claim 1 wherein the latch on the locker's spindle can be disengaged from the ratchet of the hook by downward and then upward turning of the stub, and restored to its original position by the spring so that the latch is firmly held by the ratchet to form a locking structure.

* * * * *